United States Patent [19]

Oguri

[11] Patent Number: 4,524,439

[45] Date of Patent: Jun. 18, 1985

[54] ELECTROMAGNETIC PICKUP CARTRIDGE WITH FLUX SENSORS MOUNTED ABOVE MOVING MAGNET

[75] Inventor: Katsuhiko Oguri, Yokohama, Japan

[73] Assignee: Victor Company of Japan, Limited, Yokohama, Japan

[21] Appl. No.: 597,807

[22] Filed: Apr. 9, 1984

Related U.S. Application Data

[63] Continuation of Ser. No. 251,902, Apr. 7, 1981, abandoned.

[30] Foreign Application Priority Data

Apr. 8, 1980 [JP] Japan ..... 55-45947
Apr. 10, 1980 [JP] Japan ..... 55-47141

[51] Int. Cl.[3] ..... H04R 11/12
[52] U.S. Cl. ..... 369/136; 369/146
[58] Field of Search ..... 369/136–139, 369/146–149

[56] References Cited

U.S. PATENT DOCUMENTS

| | | | |
|---|---|---|---|
| 2,507,708 | 5/1950 | Greener | 369/146 |
| 3,763,335 | 10/1973 | Morita | 369/139 |
| 3,991,284 | 11/1976 | Braun | 369/146 |
| 4,011,417 | 3/1977 | Kageyama et al. | 369/147 |
| 4,037,060 | 7/1977 | Uchida et al. | 369/139 |
| 4,124,783 | 11/1978 | Nemoto | 369/139 |

FOREIGN PATENT DOCUMENTS

| | | | |
|---|---|---|---|
| 257496 | 10/1964 | Australia | 369/139 |
| 55-34554 | 3/1980 | Japan | 369/146 |

*Primary Examiner*—Raymond F. Cardillo, Jr.
*Attorney, Agent, or Firm*—Lowe, King, Price & Becker

[57] ABSTRACT

An electromagnetic pickup cartridge comprises a movably supported permanent magnet magnetized in the direction of the thickness thereof, a cantilever secured to the magnet with a stylus attached to the free end thereof, and a pair of magnetic flux sensors stationarily mounted above the permanent magnet at right angles to each other for sensing the angular displacement of the permanent magnet about different axes with respect to a neutral position.

2 Claims, 21 Drawing Figures

ELECTROMAGNETIC PICKUP CARTRIDGE WITH FLUX SENSORS MOUNTED ABOVE MOVING MAGNET

This application is a continuation of application Ser. No. 251,902, filed Apr. 7, 1981, now abandoned.

BACKGROUND OF THE INVENTION

The present invention relates to an electromagnetic pickup cartridge with a short-length cantilever.

Conventional stereophonic electromagnetic pickup cartridges typically comprise a movably supported permanent magnet, a cantilever secured to the magnet with a stylus at the free end thereof and a pair of stationarily mounted core structures of generally U-shaped construction. Each of the core structures comprises a pair of limbs between which the permanent magnet is located to move in response to the tracking movement of the stylus. Angular displacement of the magnet from equilibrium position establishes a low reluctance path in a given direction through one of the core structures to generate a voltage in a coil wound thereon. The core limbs of each core structure are mounted at right angles to the core limbs of the other core structures so that the cantilever is positioned at the intersection of the two core structures. With the cantilever being held in a horizontal position, one of the core limbs of each core structure thus comes to a level lower than the cantilever. The cantilever of the conventional cartridge must therefore be long enough to assure a minimum spacing between the surface of the record and the lower edge of the cartridge, which is defined by the lower portions of the core limbs, while assuring a predetermined vertical tracking angle between the cantilever and the record surface. This unavoidable lengthening of the cantilever results in an inefficient operation of the vibration system of the cartridge and hence poor frequency response characteristic.

SUMMARY OF THE INVENTION

Accordingly, the primary object of the present invention is to provide an electromagnetic pickup cartridge having a cantilever of a minimum length to assure a high fidelity response characterisitic.

The pickup cartridge constructed in accordance with the present invention comprises a movably supported permanent magnet magnetized in the direction of the thickness thereof, a cantilever secured to the magnet with a stylus attached to the free end thereof, and a pair of magnetic flux sensing means stationarily mounted above the permanent magnet for detecting angular displacement of the permanent magnet with respect to a neutral position in which the magnet is normally oriented. Each sensing means is inclined at right angles to the other sensing means to pick up signals recorded on the walls of the record groove which are at right angles to each other.

Because of the provision of the flux sensing means above the permanent magnet, the cantilever is made to have a short length while it assures a minimum spacing between the cartridge and the record surface.

In a preferred embodiment, each of the flux sensing means comprises a core structure having a pair of parallel limbs which are connected by a web. Each of the limbs is bifurcated at the free end to form a pair of limb sections which are arranged to extend across the opposite surfaces of the permanent magnet. Under equilibrium condition, the permanent magnet is positioned at the midpoint between the paired limb sections of each core limb. Angular displacement of the magnet from the equilibrium position causes a low reluctance path to be established in one of the cores structures to generate a voltage in a coil wound on the core structure.

In another preferred embodiment of the invention, the permanent magnet includes a pair of pieces spaced in the direction of its thickness to define a recess on the upper side surfaces. Each of the flux sensing means comprises a core structure of an inverted U-shaped construction having the limb portions of the inverted U extending partially into the space between the magnetic pieces of the magnet.

BRIEF DESCRIPTION OF THE DRAWINGS

The invention will be further described with reference to the accompanying drawings, in which.

DETAILED DESCRIPTION

Figure 1:
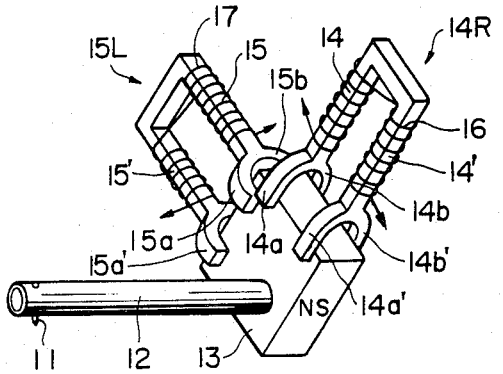
FIG. 1 is an illustration of a perspective view of a first preferred embodiment of the invention.
Figure 2:
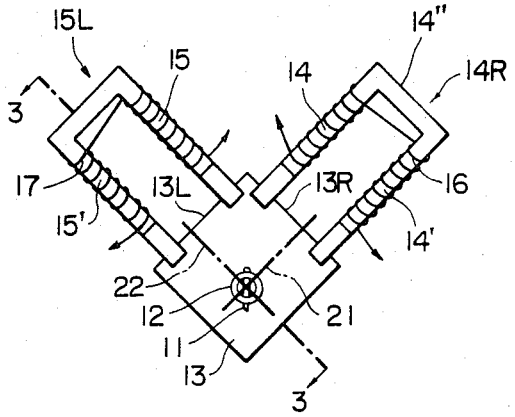
FIG. 2 is an illustration of a front view of the FIG. 1 embodiment.
Figure 3:
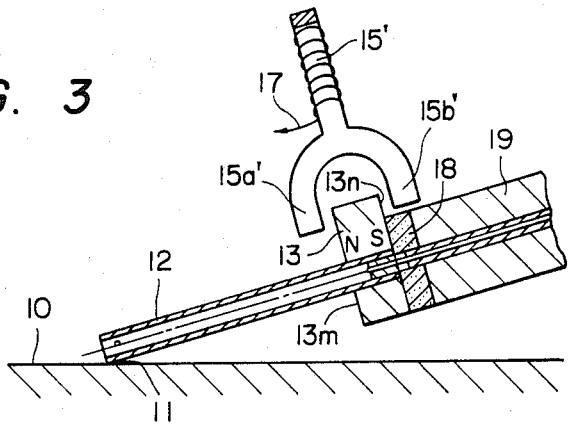
FIG. 3 is an illustration of a cross-sectional view taken along the lines 3—3 of FIG. 2.

In FIGS. 1 to 3, a preferred embodiment of the present invention is illustrated. The electromagnetic pickup cartridge of the first embodiment comprises a permanent magnet 13 which is movably secured to a holder 19 by an elastic member 18. The magnetic 13 has a square-shaped major, or front, surface 13*m* and an opposite surface 13*n* which is cemented to the elastic member 18, and is magnetized in the direction of the thickness thereof between the surfaces 13*m* and 13*n*. A cantilever 12, having a stylus 11 at one end, is connected at the other end to the permanent magnet 13. As shown in FIG. 3, the cantilever 12 is of a hollow cylindrical structure which extends into an opening provided in the magnet 13 so that the tracking movement of the cantilever 12 is efficiently transmitted to the magnet 13 as the stylus 11 keeps track of record grooves on a disc record 10.

The present invention is characterized by the inclusion of a pair of magnetic flux sensing means stationarily located above the permanent magnet 13. More specifically, the magnetic flux sensing means comprise a pair of open-ended core structures 14R and 15L of identical construction. The core 14R comprises a pair of limbs 14 and 14′ which are connected together by a web 14″.

The limb 14 has its lower end bifurcated to form a pair of limb sections 14*a* and 14*b* and the limb 14' has its lower end similarly bifurcated to form a pair of limb sections 14*a'* and 14*b'*. The limb sections 14*a*, 14*b*, 14*a'* and 14*b'* constitute flux sensing core pieces and extend in pairs over a side surface 13R of the moving magnet 13 from its major surface to the opposite surface. In a similar fashion, the core structure 15L comprises a pair of limbs 15 and 15' having pairs of limb sections 15*a*, 15*b* and limb sections 15*a'*, 15*b'*. These limb sections extend over a side surface 13L of the magnet 13 from its major surface to the opposite surface. Under normal conditions, the permanent magnet 13 is positioned at midpoint between the limb sections 14*a*, 14*a'*, 15*a*, 15*a'* and the limb sections 14*b*, 14*b'*, 15*b*, 15*b'*. For purposes of detecting changes in magnetic flux generated as a result of an angular displacement of the permanent magnet, the cores 14R and 15L are wound with coils 16 and 17 respectively on their limbs to generate right- and left-channel signals, respectively.

Figure 4A:
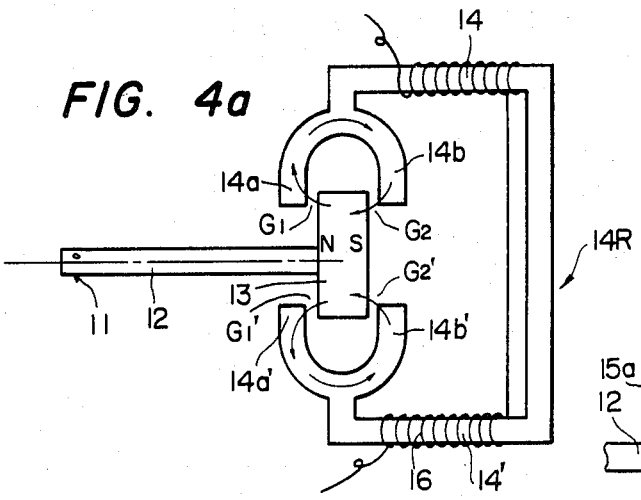
FIGS. 4*a* to 4*e* are illustrations of explanatory views for the understanding the operations of the FIG. 1 embodiment.

The operation of the pickup cartridge of the first embodiment will be visualized with reference to FIGS. 4*a* to 4*e* in which the limb sections of the cores are shown schematically on an equal plane for clarity. The permanent magnet 13 is located in a neutral position with respect to the limb sections or core pieces 14*a*, 14*b*, 14*a'* and 14*b'* when the cantilever 12 is in the normal position, so that they define equal air gaps G1, G2, G1' and G2' as illustrated in FIG. 4*a*.

In this equilibrium condition, the magnet 13 is located symmetrically with respect to the limb sections of the core structure 14R so that air gaps G1, G2, G1', G2' are equal to each other. Therefore, the magnetic flux from the north pole N on the major surface returns to the south pole S through the limb sections as indicated by the arrows in FIG. 4*a* bypassing the core limbs where the coil 16 (17) is wound. Thus, no voltage is developed in the sensing coil 16 or 17.

Figure 4D:
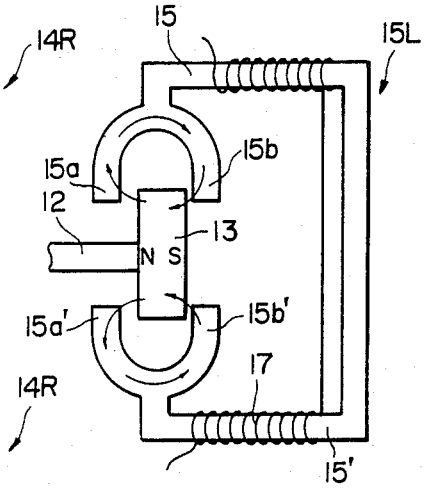
Figure 4B:
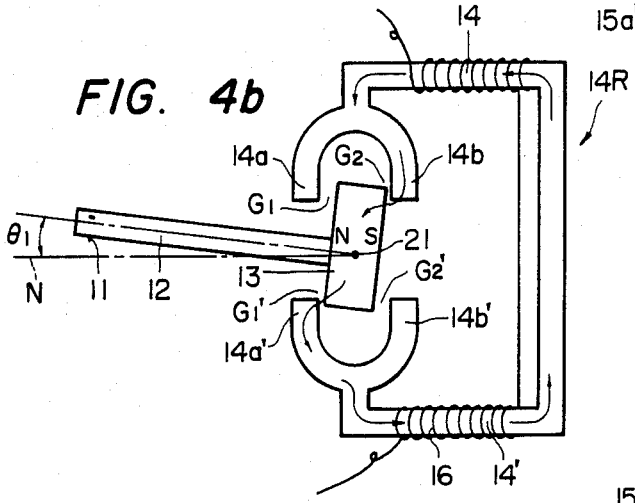

When the cantilever 12 is deflected in a manner as shown in FIG. 4*b* causing the magnet 13 to rotate about an axis 21 in the clockwise direction (see FIG. 2), the magnet 13 is angularly displaced from the neutral or normal position resulting in a narrowing of gaps G2 and G1' and a widening of gaps G1 and G2'. Thus a low reluctance path is established in the counterclockwise direction in the core 14R as indicated by the arrows in FIG. 4*b* to develop a voltage in the coil 16 proportional to the rate of change in the flux linkage and hence to the angular displacement of the magnet from the neutral position. If the deflection of the cantilever 12 produces no rotary movement in the magnet 13 about an axis 22 which is perpendicular to the axis 21, the magnet 13 is equally displaced in the left core 15L as shown in FIG. 4*d* and as a result there is no voltage developed in the coil 17.

Figure 4E:
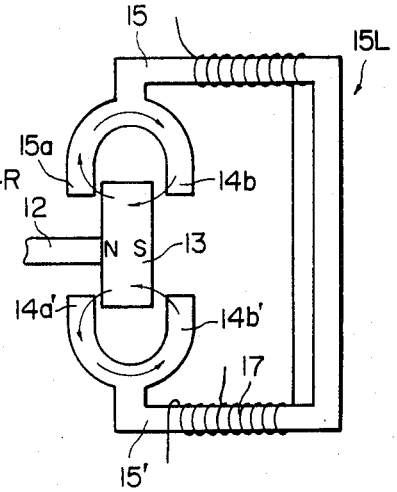
Figure 4C:
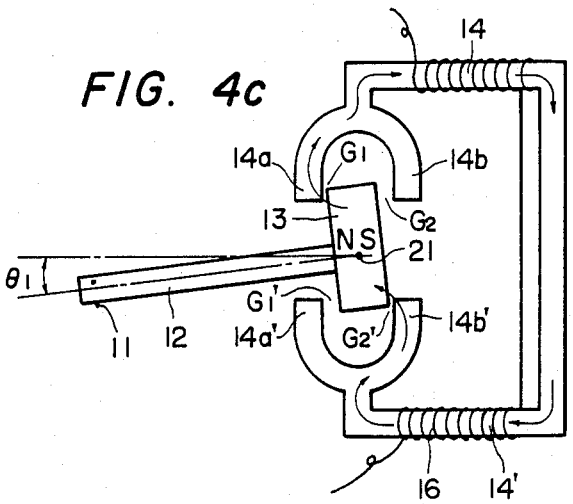

When the cantilever 12 is deflected in the opposite direction as shown in FIG. 4*c* causing the magnet 13 to twist only about its axis 21 in the counterclockwise direction, a low reluctance path is established in the clockwise direction as indicated by the arrows in FIG. 4*c* in the core 14R. On the other hand, the portion of the magnet 13 associated with the left core 15L is equally displaced as shown in FIG. 4*e* in a direction opposite to that of FIG. 4*d*. A voltage is thus developed in the coil 16 while no voltage is developed in the coil 17.

By the provision of the flux sensing means above the moving magnet 13, the lower edge of the cartridge, which is determined by the lower edge of the magnet 13, can be lowered to a minimum distance above the surface of the disc record 10, as shown in FIG. 3, while the cantilever 12 is allowed to extend at a normal vertical tracking angle to the record surface, whereby the length of the cantilever 12 can be minimized.

Figure 5:
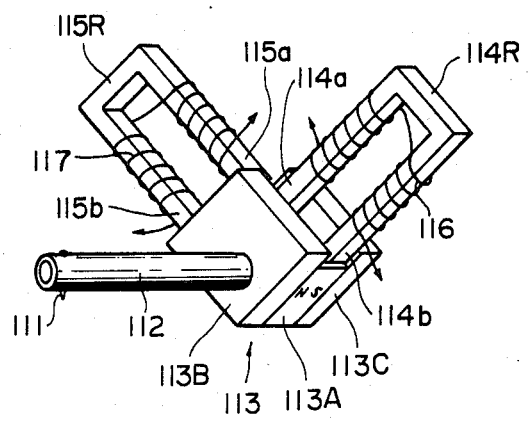
FIG. 5 is an illustration of a perspective view of a second embodiment of the invention.
Figure 6:
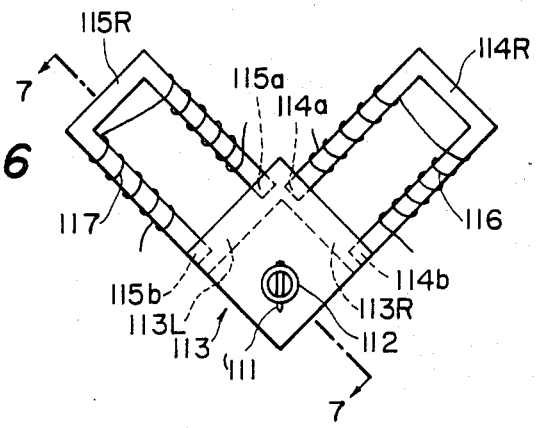
FIG. 6 is an illustration of a front view of the FIG. 5 embodiment.
Figure 7:
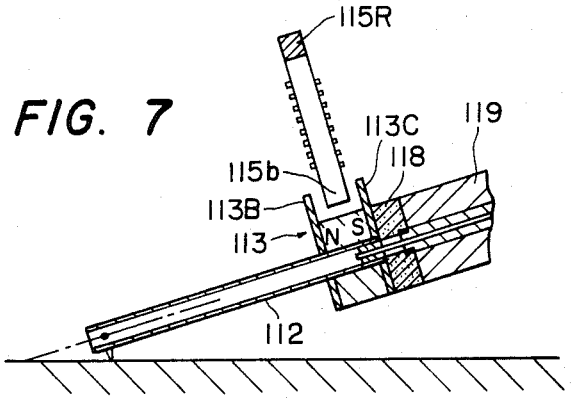
FIG. 7 is an illustration of a cross-sectional view taken along the lines 7—7 of FIG. 6.

An alternative embodiment of the invention is illustrated in FIGS. 5 to 7. The cartridge of this alternative embodiment comprises a moving magnet 113 which is formed by a center piece 113A sandwiched between a front piece 113B and a rear piece 113C. As seen from FIG. 6, the front and rear pieces 113A and 113C are larger than the center piece 113A to define a right-side groove 113R and a left-side groove 113L which are at right angles to each other. The center piece 113A is magnetized in the direction of its thickness and the front and rear pieces may be formed of pure iron or permalloy.

The magnetic flux sensing means comprises a pair of inverted-U shaped core structure 114R and 115L which are stationarily mounted with respect to the moving magnet 113 with the lower ends of their core limbs received in the grooves 113R and 113L, respectively.

Figure 8A:
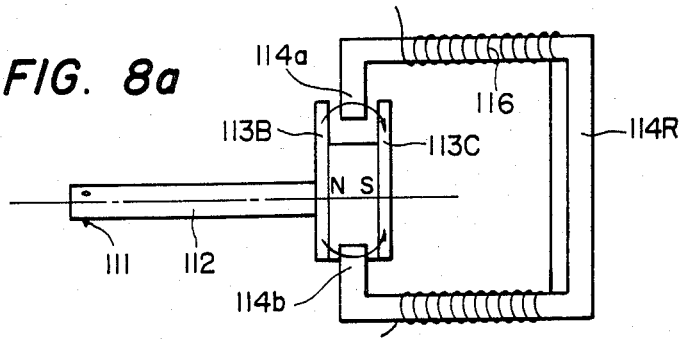
FIGS. 8*a* to 8*c* illustrations of explanatory views for the understanding of the operation of the FIG. 5 embodiment.
Figure 8B:
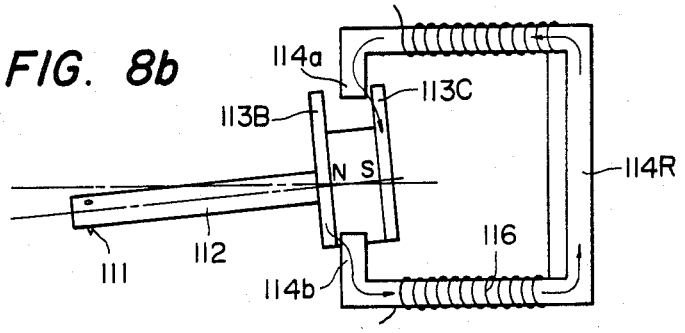
Figure 8C:
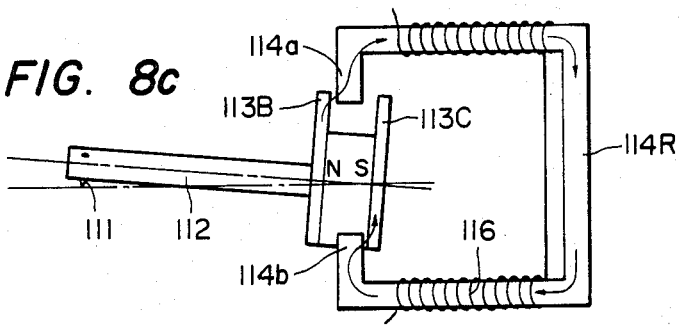

The operation of the embodiment of FIG. 5 will be understood with the aid of explanatory views shown in FIGS. 8*a* to 8*c*. With the cantilever 112 being in an equilibrium position, FIG. 8*a*, there are equal amounts of air gaps between the core limbs 114*a*, 114*b* and front and rear magnet pieces 113B, 113C causing the magnetic flux to find a low reluctance path as indicated by the arrows in FIG. 8*a*. When the cantilever 112 is deflected in the counterclockwise direction, the front and rear pieces 113B and 113C are brought near to the core limbs 114*b* and 114*a*, respectively, as shown in FIG. 8*b*, thus creating a low reluctance path in the counterclockwise direction as indicated by the arrows in FIG. 8*b* to generate a voltage in the coil 116. Thus, the deflection of the cantilever 112 in the opposite direction, FIG. 8*c*, causes the front and rear magnet pieces to deflect in the opposite direction to that shown in FIG. 8*b* to produce a low reluctance path in the clockwise direction to generate a voltage in the coil 116.

Figure 9:
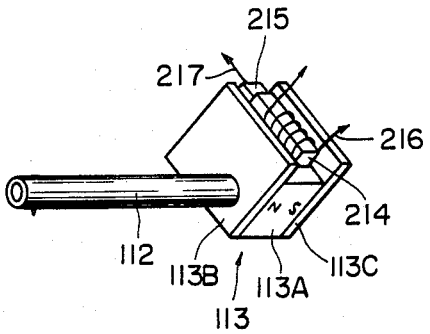
FIGS. 9 and 10 are illustrations of a modification of the FIG. 5 embodiment.
Figure 11A:
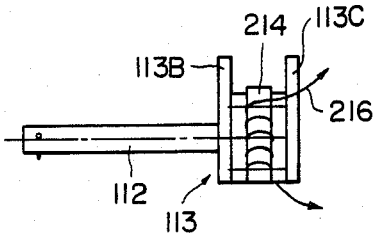
FIGS. 11*a* to 11*c* are illustrations of explanatory views associated with the embodiment of FIG. 9.
Figure 10:
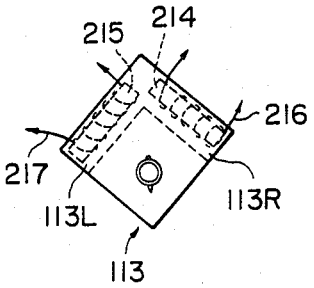

FIGS. 9 and 10 are illustrations of a further alternative embodiment of the invention which differs from the embodiment of FIG. 5 in that the flux sensing means comprises a pair of an elongated cores 214 and 215 with respective coils 216 and 217. The cores 214 and 215 are stationarily mounted with respect to the moving magnet 113 in the grooves 113R and 113L at right angles to each other. With the cantilever 112 being in a neutral position, FIG. 11*a*, the cores 214 and 215 are positioned at a midpoint between the magnetic pieces 113B and 113C, whereby the magnetic flux traverses the cores at right angles to their lengths and produces no voltage in the coils 216 and 217.

Figure 11B:
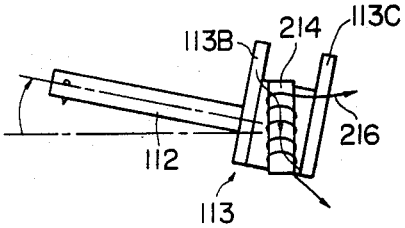
Figure 11C:
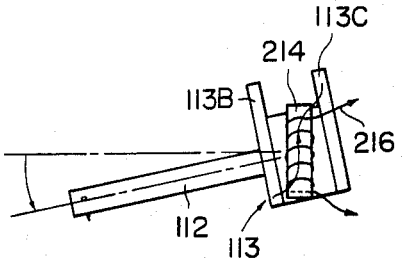

With a deflection of the cantilever 112 in the counterclockwise direction such that the moving magnet 113 is rotated only with respect to the core 214 as shown in FIG. 11*b*, the flux from the front magnet piece 113B finds a low reluctance path through the core 214 in a direction as indicated by the arrow in FIG. 11*b* to the rear piece 113C producing a voltage in the coil 216 and no voltage in the coil 217. In a counterclockwise movement of the cantilever 112, FIG. 11*c*, the flux will find a low reluctance path in the opposite direction to that of FIG. 11*b* to develop a voltage in the coil 216.

Figure 12:
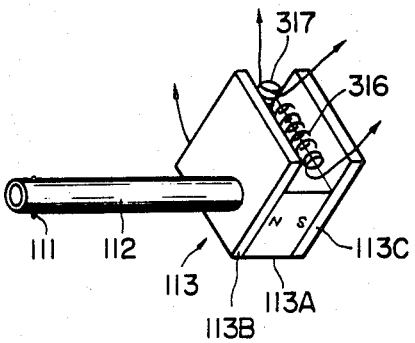
FIGS. 12 and 13 are illustrations of a modification of the embodiment of FIG. 9.
Figure 13:
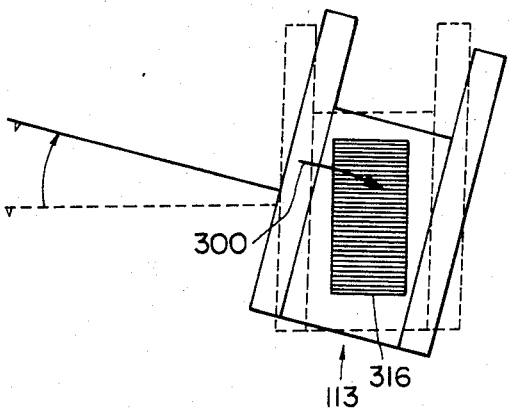

The embodiment of FIG. 9 can be modified as illustrated in FIG. 12 in which the flux sensing means comprises a pair of coils 316 and 317 eliminating the cores 214 and 215 of the previous embodiment. Voltages are developed in the coil 316, for example, by the flux which traverses it at an angle thereto as indicated by the arrow 300 in FIG. 13 when the cantilever is deflected. The magnitude of the generated voltage is proportional to the angular displacement of the moving magnet 113 with respect to the longitudinal direction of the coils. The elimination of cores permits the coils to generate a signal free from distortion which would otherwise occur in the cores.

What is claimed is:

1. An electromagnetic pickup cartridge comprising:

a movably supported flux generating means having a pair of spaced apart parallel portions of opposite polarities for generating parallel magnetic flux lines therebetween;

a cantilever having one end thereof coupled to one of said portions such that the cantilever extends in a direction aligned with the direction of said flux lines; and a coreless structure having a coil stationarily located between said portions, said coil being wound about an axis perpendicular to the direction of said magnetic flux lines when said flux generating means is in a neutral position for generating a signal exclusively as a function of the angular displacement of said flux generating means from said neutral position.

2. An electromagnetic pickup cartridge as claimed in claim 1, further comprising a second coreless structure having a coil stationarily located in said flux lines at a right angle to the first-mentioned coil.

* * * * *